US010844570B2

(12) United States Patent
Cascarino et al.

(10) Patent No.: US 10,844,570 B2
(45) **Date of Patent: *Nov. 24, 2020**

(54) DRILLING MACHINE

(71) Applicant: SOLETANCHE FREYSSINET, Rueil Malmaison (FR)

(72) Inventors: Sara Cascarino, Rueil Malmaison (FR); Daniel Perpezat, Rueil Malmaison (FR); Laurent Pivert, Rueil Malmaison (FR); Régis Bernasinski, Rueil Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 159 days.

This patent is subject to a terminal disclaimer.

(21) Appl. No.: 15/758,774

(22) PCT Filed: Sep. 8, 2016

(86) PCT No.: PCT/FR2016/052247

§ 371 (c)(1),
(2) Date: Mar. 9, 2018

(87) PCT Pub. No.: WO2017/042496

PCT Pub. Date: Mar. 16, 2017

(65) Prior Publication Data

US 2018/0305885 A1 Oct. 25, 2018

(30) Foreign Application Priority Data

Sep. 10, 2015 (FR) ..... 15 58426

(51) Int. Cl.

| | |
|---|---|
| ***E02D 17/13*** | (2006.01) |
| ***E02D 17/04*** | (2006.01) |
| *E02D 5/34* | (2006.01) |

(52) U.S. Cl.
CPC ..... *E02D 17/13* (2013.01); *E02D 17/04* (2013.01); *E02D 5/34* (2013.01)

(58) Field of Classification Search
CPC . E02D 17/13; E02D 17/04; E02D 5/34; E02F 3/205
See application file for complete search history.

(56) References Cited

U.S. PATENT DOCUMENTS 3,894,587 A * 7/1975 Sourice ..... E02D 17/13 175/91
4,824,176 A * 4/1989 Barre ..... E02F 3/205 175/91

(Continued)

FOREIGN PATENT DOCUMENTS

| | | |
|---|---|---|
| CA | 2772587 | 2/2012 |
| CN | 2840625 | 11/2006 |

(Continued)

OTHER PUBLICATIONS

Chinese Office Action for CN2016800644542 dated Oct. 23, 2019.

*Primary Examiner* — Jamie L McGowan
(74) *Attorney, Agent, or Firm* — Workman Nydegger

(57) ABSTRACT

A drilling machine (10) for making an excavation in ground (S) in a vertical drilling direction (F). The drilling machine (10) includes: a support (12) having a longitudinal direction (L); a drilling module (14) provided with cutter members (16), the drilling module being movable in translation relative to the support; and a movement device arranged between the support and the drilling module in order to move the drilling module (14) relative to the support along the longitudinal direction of the support. The machine is characterized by the fact that the movement device includes a damper (70) for damping the vibration generated by the drilling module while drilling.

13 Claims, 5 Drawing Sheets

(56) References Cited

U.S. PATENT DOCUMENTS

| | | | | |
|---|---|---|---|---|
| 5,267,902 | A * | 12/1993 | Arzberger | E02D 17/13 464/89 |
| 7,367,143 | B2 * | 5/2008 | Stoetzer | E02D 17/13 175/91 |
| 7,637,038 | B2 * | 12/2009 | Arzberger | E02F 3/205 299/34.11 |
| 8,640,364 | B2 * | 2/2014 | Arzberger | E02D 17/13 37/189 |
| 2003/0037464 | A1 * | 2/2003 | Gessay | E02D 17/13 37/189 |
| 2003/0074810 | A1 * | 4/2003 | Gessay | E02D 17/13 37/347 |
| 2005/0091885 | A1 * | 5/2005 | Arzberger | E21B 4/003 37/347 |
| 2009/0031590 | A1 | 2/2009 | Arzberger et al. | |
| 2012/0152614 | A1 * | 6/2012 | Rodgers | E21B 43/1195 175/2 |
| 2014/0225417 | A1 * | 8/2014 | Meinders | E02F 5/08 299/39.4 |

FOREIGN PATENT DOCUMENTS

| | | |
|---|---|---|
| CN | 102575500 | 7/2012 |
| CN | 203230639 | 10/2013 |
| FR | 2806112 | 9/2001 |

* cited by examiner

FIG.2
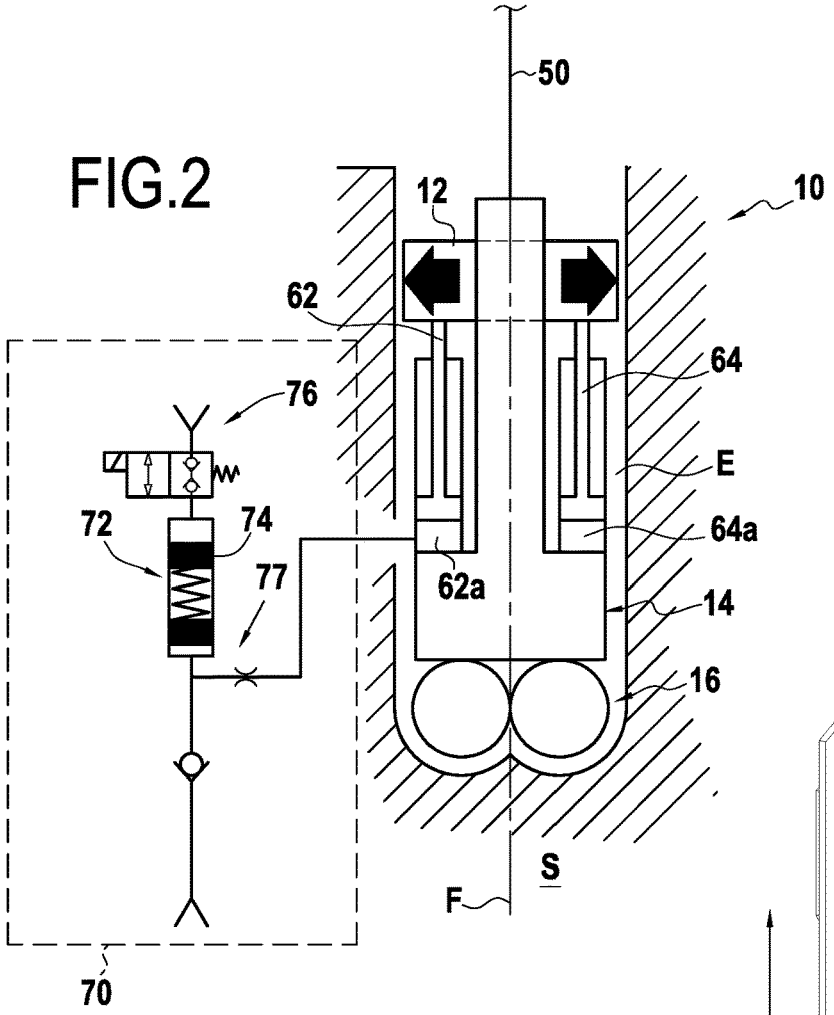
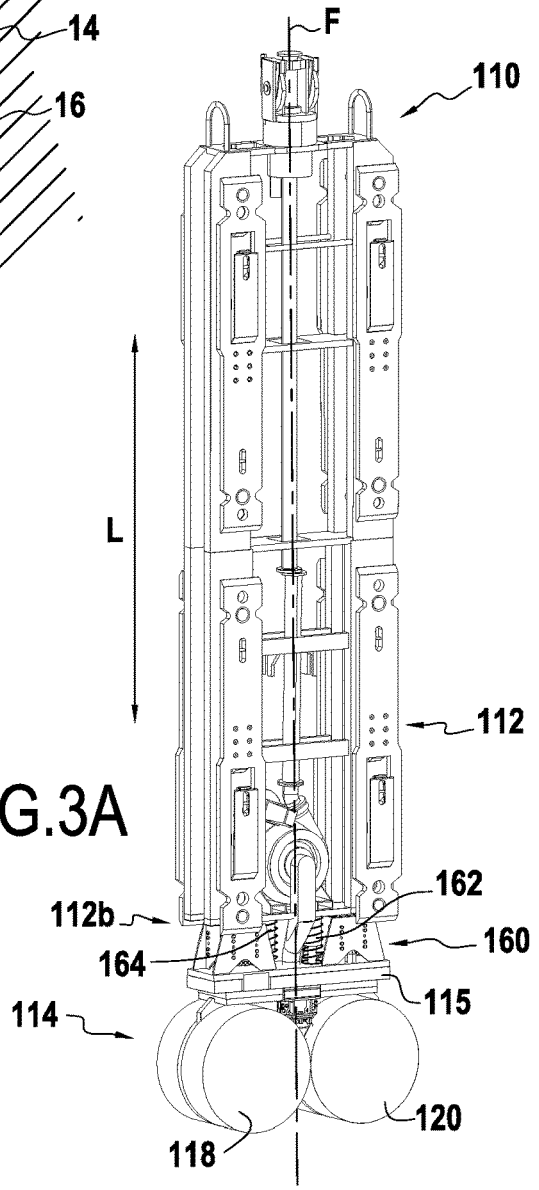
FIG.3A

DRILLING MACHINE

BACKGROUND OF THE INVENTION

The present invention relates to the field of drilling in the ground, in particular for constructing foundations, e.g. such as continuous screens constituted by juxtaposed concrete wall elements.

The invention relates more precisely to a drilling machine for making excavations in the ground, and more particularly in hard soil.

The invention relates in particular to a drilling machine for making an excavation in ground in a drilling direction that is substantially vertical, said drilling machine comprising:

a support having a longitudinal direction that is substantially vertical;

a drilling module provided with cutter members, the drilling module being movable in translation relative to the support along the longitudinal direction of the support; and a movement device arranged between the support and the drilling module in order to move the drilling module relative to the support along the longitudinal direction of the support.

This type of drilling machine is generally used for drilling in hard soil, e.g. in granite. The movement device serves to exert additional thrust on the drilling tools, for the purpose of facilitating excavation. Another advantage is to enable the thrust that is exerted on the cutter members to be steered accurately.

It is known that drilling in hard soil leads to vibration appearing in the drilling module, which vibration propagates throughout the machine and can damage the structure of the drilling machine. This applies in particular when the drilling machine is a milling machine. The rotary cutter tools are not permanently in contact with the soil: each tool strikes it each time the drum revolves through one turn. The sum of all of those impacts gives rise to vibration in the drilling machine. The impacts become more violent when the soil is harder.

OBJECT AND SUMMARY OF THE INVENTION

An object of the present invention is to remedy the above-mentioned drawbacks by proposing a drilling machine that is more robust for drilling in hard soil.

The invention achieves this object by the fact that the movement device includes damper means for damping the vibration generated by the drilling module while drilling.

The vibration generated as a result of the impacts to which the cutter members are subjected during drilling are thus damped by the damper means that are arranged between the drilling module and the support. Thus, thanks to the invention, the vibration generated by the drilling module is damped and thus affects neither the cutter members nor the support, thereby advantageously avoiding damage to the drilling machine.

In the invention, the movement device performs two functions, one of moving the drilling module relative to the support, and another of damping the vibration generated by the cutter members of the drilling module.

In a first embodiment, the movement device includes at least one hydraulic actuator connected to the support to the drilling module, and the damper means comprise a hydraulic damper device in fluid flow connection with the hydraulic actuator.

The hydraulic actuator is advantageously arranged between the support and the drilling module. It serves firstly to make it possible to move the drilling module in translation relative to the support.

It can be understood that in this first embodiment, damping is performed hydraulically, with the hydraulic damper device. Preferably, but not exclusively, this device comprises a spring accumulator together with at least one constriction. In the event of an impact, the oil contained in one of the chambers of the hydraulic actuator is compressed and flows through the constriction to the spring accumulator in order to damp the rise in pressure of the oil, thereby performing damping. The leakage flow rate through the constriction and the prestress of the spring of the spring accumulator are preferably adjustable remotely, thereby making it possible to adjust the damping coefficient and the resistance to reverse movement of the actuators as a function of the weight that is applied on the cutter members.

In a preferred variant, the drilling module has a bottom section carrying the cutter members, and a top section that passes longitudinally through said support, the top section being slidably mounted relative to said support and presenting a top end connected to the bottom end of a lift cable.

It can thus be understood that the drilling module is suspended from the lift cable. The lift cable is preferably actuated using a winch connected to a carrier. More preferably, the top end of the top section projects beyond the top end of the support.

Preferably, the support is a frame of transverse dimensions considered in a plane perpendicular to the longitudinal direction that are substantially equal to or less than the transverse dimensions of the drilling module, and the frame includes an anchor device suitable for preventing the support from moving relative to the walls of the excavation.

The anchor device serves in particular to prevent vertical movement of the drilling machine in the ground.

Thus, in the invention, it is possible to prevent the frame from moving in the ground while controlling the vertical movement of the drilling module by using the lift cable. The hydraulic damper device absorbs the vibration, which is not transmitted to the frame.

In a second embodiment of the invention, the movement device comprises at least one hydraulic actuator that is arranged between the support and the drilling module, and the damper means comprise a spring member arranged between the support and the drilling module. It can be understood that the spring member is arranged in parallel with the hydraulic actuator. Preferably, but not exclusively, the spring member is coaxial about the actuator.

The spring member preferably comprises a spring.

In a third embodiment of the invention, the support comprises a boom; the cutter members are situated at the bottom end of a bar of the drilling module, and the movement device comprises a carriage mounted on the boom to be slidable along the longitudinal direction of the boom, the carriage co-operating with said bar to move the bar together with the drilling module along the longitudinal direction of the boom.

The bar, which is traditionally referred to as a "Kelly", and the boom are substantially parallel and extend in a direction that is substantially vertical. It can be understood that moving the carriage has the effect of moving the drilling module relative to the support.

In particularly advantageous manner, the carriage includes the damper means.

Thus, by means of the invention, the vibration generated by the drilling module is not transmitted to the boom, nor to the carrier vehicle supporting it.

In an advantageous variant, the carriage comprises a first portion slidably mounted on the boom and a second portion co-operating with the bar, and the damper means are arranged between the first and second portions of the carriage.

The first and second portions are preferably slidably mounted relative to each other along the longitudinal direction of the boom.

Preferably, the damper means comprise a spring member arranged between the first and second portions of the carriage. The spring member is preferably made up of a damper together with a coaxial spring. Alternatively, the damper means comprise a hydraulic damper device of the same type as that mentioned above.

Advantageously, in combination with any of the above-described embodiments, the drilling module further comprises an anti-swinging device to prevent horizontal movement of the drilling module while drilling.

Advantageously, the anti-swinging device comprises deployable pads arranged on the lateral sides of the drilling module and configured to bear against at least one of the walls of the excavation.

An advantage is to prevent the drilling module swaying, thus making it possible to avoid the drilling path deviating from the desired path, and also to avoid non-useful movements of the cutter members.

Advantageously, the drilling machine further comprises a device for regulating the damping coefficient of the damper means. An advantage is to be able to adapt the damper means to the nature of the soil and to the thrust exerted on the cutter members.

Advantageously, the drilling machine is a milling machine having cutter members comprising two pairs of drums that are rotatable about axes of rotation that are parallel, distinct, and perpendicular to the longitudinal direction of the support.

BRIEF DESCRIPTION OF THE DRAWINGS

The invention can be better understood on reading the following description of embodiments of the invention given as non-limiting examples and with reference to the accompanying drawings, in which:

FIG. 2 shows an example of damper means for the FIG. 1 movement device;

FIGS. 3A and 3B show a second embodiment of the invention in which the damper means comprise springs arranged between the frame and the drilling module.

DETAILED DESCRIPTION OF THE INVENTION

Figure 1:
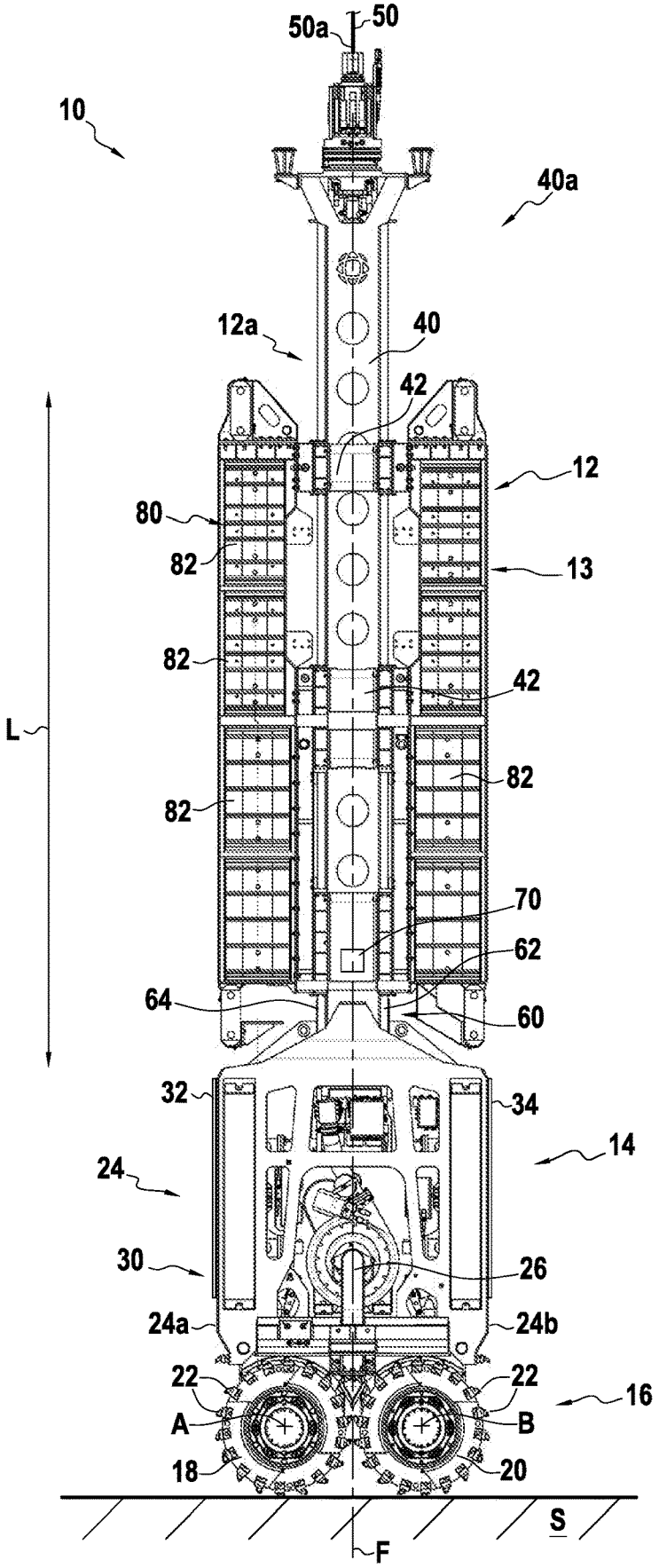
FIG. 1 shows a first embodiment of the drilling machine of the invention in which the movement device comprises hydraulic actuators.

FIG. 1 shows a first embodiment of the drilling machine 10 of the present invention. The drilling machine 10 is used to make an excavation E in ground S along a drilling direction F that is substantially vertical.

The drilling machine 10 comprises a support 12 having a longitudinal direction L that is substantially vertical in this example. The drilling machine 10 also comprises a drilling module 14 provided with cutter members 16. In this example, the drilling machine 10 is a milling machine in which the cutter members 16 comprise two pairs of drums 18, 20 provided with cutter teeth 22, the two pairs of drums 18, 20 being mounted to rotate about respective axes of rotation A, B that are parallel, distinct, and perpendicular to the longitudinal direction L of the support 12.

The drilling module 14 comprises a bottom section 24 that carries the cutter members 16, and in particular the drums 18, 20. The bottom section 24 further comprises a pump module 26 that serves to suck up fragments of excavated ground in order to discharge them to the surface.

The drilling module 14 also comprises an anti-swinging device 30 for preventing horizontal movement of the drilling module 14 while drilling. The anti-swinging device comprises deployable pads 32, 34 that are arranged on the lateral sides 24*a*, 24*b* of the bottom section 24 of the drilling module 14. These deployable pads are arranged to co-operate with the walls of the excavation when they are deployed horizontally. The deployable pads 32, 34 are actuated by actuators (not shown) arranged in the bottom section 24 of the drilling module 14.

The drilling module 14 also comprises a top section 40 that extends vertically above the bottom section 24, the top section 40 in this example being in the form of a bar that passes longitudinally through the support 12. In this example, the support 12 is a frame that includes guide members 42 in which the top section 40 is slidably mounted. It can thus be understood that the top section 40 is mounted to slide relative to the frame 13 in a direction that is substantially vertical, whereby the drilling module 14 is movable in translation relative to the support 12.

In this first embodiment, the drilling module is thus movable in translation relative to the support along the drilling module direction F, which is substantially vertical.

The top section 40 of drilling module 14 presents a top end 40*a* that projects above the top end 12*a* of the support 12, this top end 40*a* being connected to the bottom end 50*a* of a lift cable 50. The lift cable 50 is connected to the top end of a carrier (not shown) that is itself known.

The drilling module 10 also comprises a movement device 60 that is arranged between the support 12 and the drilling module 14 and that serves to move the drilling module 14 relative to the support 12 along the longitudinal direction of the support. In other words, the movement device serves to move the drilling module relative to the support along the drilling direction F, which is substantially vertical.

In the first embodiment, the movement device 60 comprises a pair of hydraulic actuators 62, 64 that connect the support 12 to the bottom section 24 of the drilling module 14. It can thus be understood that the hydraulic actuators 62, 64 are connected to the support 12 and to the drilling module 14 in such a manner that actuating them enables the drilling module to be moved vertically relative to the support 12.

In accordance with the invention, the movement device 60 further comprises damper means 70 for damping the vibration generated by the drilling module 14 while drilling.

FIG. 2 shows diagrammatically the drilling machine 10 in the first embodiment of the invention, together with the damper means 70. The damper means comprise a hydraulic damper device 72 that is in fluid flow connection with the hydraulic actuators 62, 64. In this example, the damper device comprises a spring accumulator 74 and a constriction 77. When the cutter members 16 are subjected to impacts, the oil contained in the large chambers 62*a*, 64*a* of the hydraulic actuators 62, 64 is compressed and flows towards the spring accumulator 74 through the constriction 77, which thus damps the rise in pressure in the oil, thereby providing damping. The damper means 70 further comprise a device 76 for regulating the stiffness coefficient of the damper means, and more precisely the stiffness of the spring accumulator 74. They also comprise means for regulating the leakage flow rate through the constriction 77 so as to regulate the damping coefficient of the damper means. Thus, during an impact, the vibration generated by the cutter members is not transmitted to the support 12.

In another aspect of the invention, the frame 13 includes an anchor device 80 that is suitable for preventing the support 12 from moving relative to the walls of the excavation. The anchor device 80 comprises a plurality of deployable anchor pads referenced 82 that are configured to bear against the larger faces of the excavation in order to hold the support 12 stationary in the excavation.

Figure 3B:
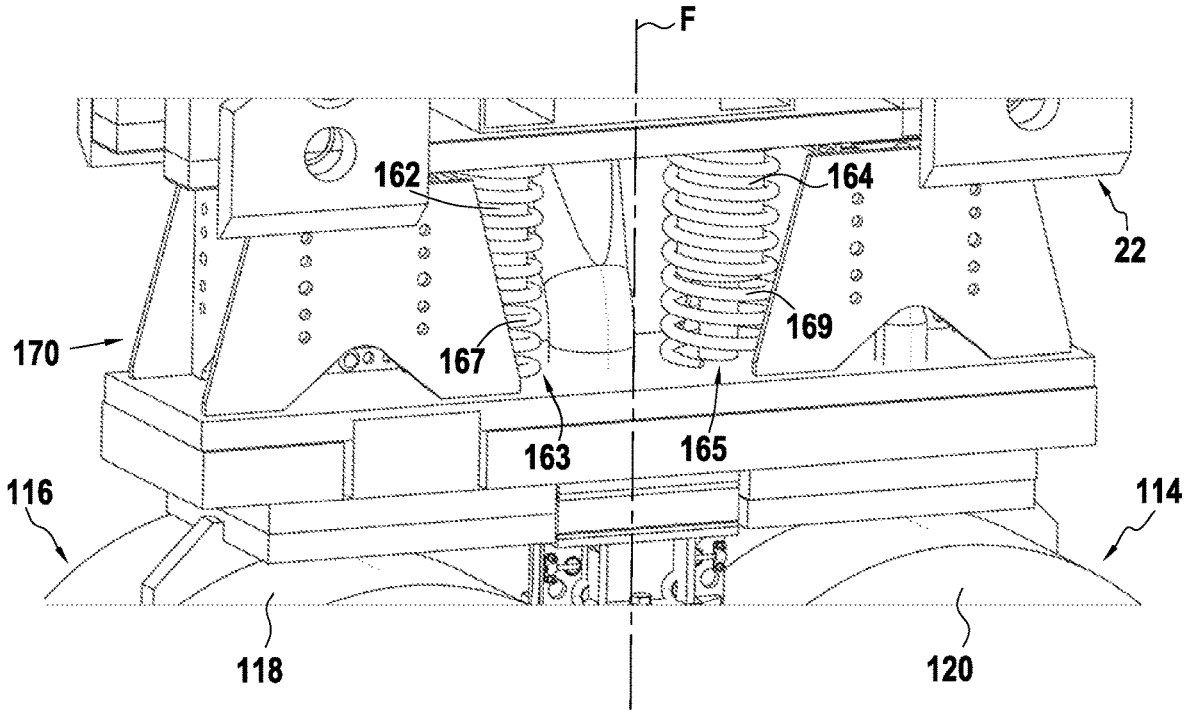

With reference to FIGS. 3A and 3B, there follows a description of a second embodiment of the drilling machine 110 of the invention. Features that are identical to those of the first embodiment are given the same numerical references plus the value one hundred. The drilling machine 110 shown in FIG. 3A thus comprises a movement device 160 connecting the support 112 to the drilling module 114. In this example, the drilling module 114 has a platform 115 that supports the rotary drums 118, 120. The movement device 160 has a pair of actuators 162, 164 that connects the bottom end 112*b* of the support 112 to the platform 115. Actuating the hydraulic actuators 162, 164 enables the drilling module 114 to be moved in translation relative to the support 112 along the drilling direction F.

In this second embodiment, the damper means 170, clearly visible in FIG. 3B, comprise the hydraulic actuators 162, 164 together with two damper members 163, 165 that are arranged between the support 112 and the drilling module 114. In this example, the damper members 163, 165 comprise springs 167, 169 surrounding the hydraulic actuators 162, 164.

Associating springs 167, 169 with the hydraulic actuators 162, 164 thus constitutes the damper means that serve to damp the damper means that have the function of damping the vibration generated by the drilling module 114 while drilling, and consequently to prevent vibration being transmitted to the support 212. Without going beyond the ambit of the invention, the springs 167, 169 could be arranged beside the hydraulic actuators 162, 164 without being coaxial about them.

Figure 4A:
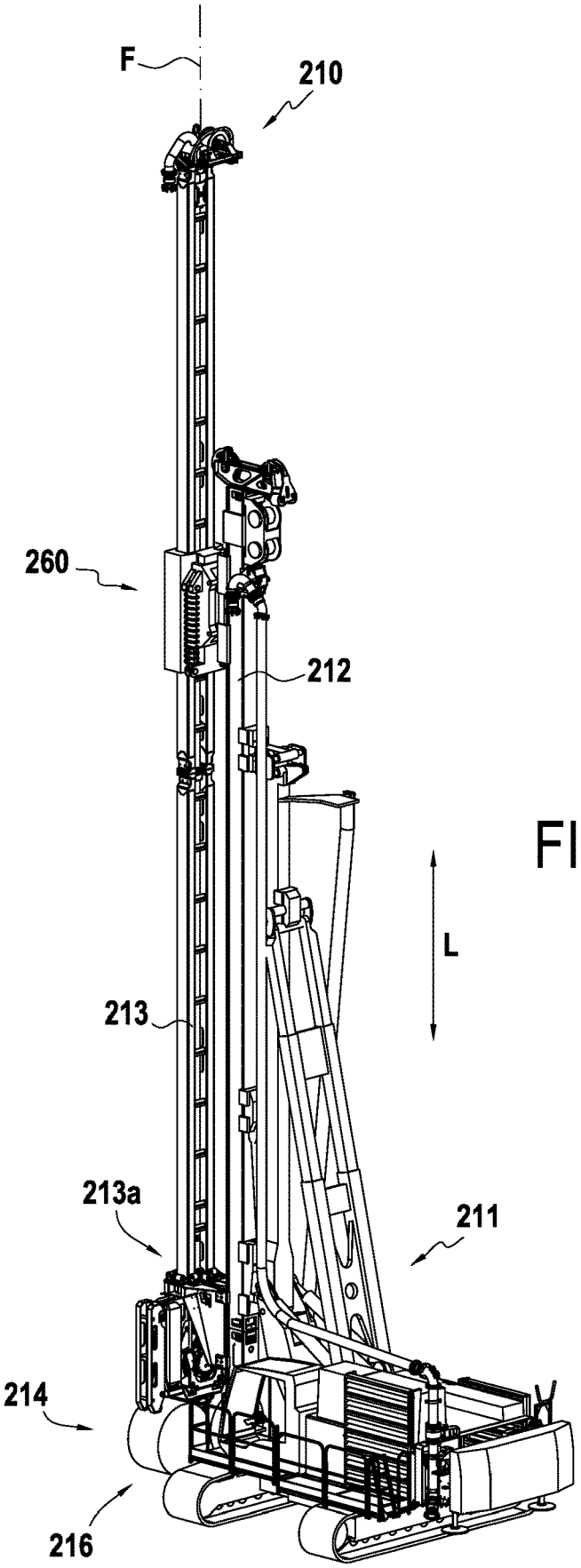
FIGS. 4A and 4B show a third embodiment of the invention in which the movement device comprises a carriage slidably mounted on a boom.
Figure 4B:
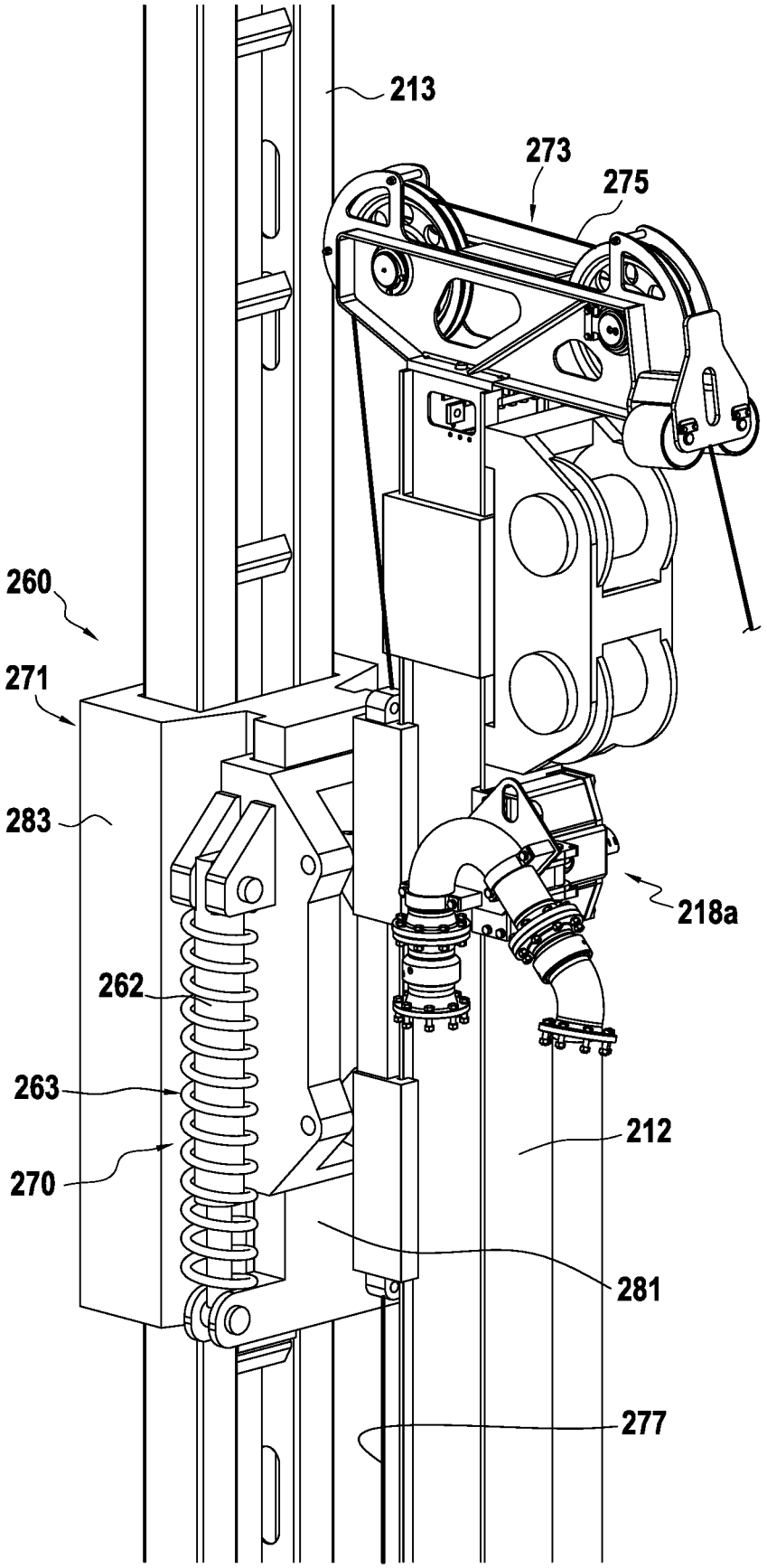

With reference to FIGS. 4A and 4B, there follows a description of a third embodiment of the support 210 of the present invention. Once more, elements that are identical to those of the first embodiment are given the same numerical references plus the value of two hundred. In this third embodiment, the drilling machine 210 has a crawler-tracked carrier 211 to which the support 212 is fastened, which support in this example is in the form of a vertically extending longitudinal boom.

The cutter members 216 of the drilling module 214 are situated at the bottom end 213*a* of a longitudinal bar of the drilling module, traditionally referred to as a "Kelly".

The movement device 260 is arranged between the boom 212 and the bar 213 of the drilling module 214, and it serves to move the drilling module 214 relative to the boom 212 in the longitudinal direction L of the boom. To do this, the movement device 260 comprises a carriage 271, better seen in FIG. 4B, that is mounted on the boom 212 so as to be slidable along the longitudinal direction L of the boom. The carriage 271 co-operates with the bar 213 to move the drilling module 214 along the longitudinal direction of the boom. In this example, the carriage 271 includes a securing device that enables the bar 213 to be secured to said carriage 271 so that moving the carriage 271 along the longitudinal direction L of the boom 212 gives rise to the drilling module 214 moving together therewith along the drilling direction. The carriage 271 is moved up and down in this example by a movement member 273 comprising cables 275 and 277 that are fastened to opposite ends of the carriage 271.

It can be understood that the carriage 271 is moved towards the top and bottom ends of the boom 212 by exerting traction on the cables 275 and 277, which cables are actuated by one or more winches (not shown) arranged on the carrier, such winches themselves being well known.

The carriage 271 has a first portion 281 that is fastened to the boom 212 in slidable manner, the first portion 281 being connected to the end of the cable 275. The carriage 271 also has a second portion 283 that carries the bar 213 while being mounted to slide relative to the first portion of the carriage along the longitudinal direction of the bar 213.

In the invention, the movement device 260 further comprises damper means 270 for damping the vibration generated by the drilling module 214 while drilling. The damper means 210 are arranged between the first and second portions 281, 283 of the carriage 271. It can be understood that in this second embodiment, it is the carriage 271 of the movement device 260 that comprises the damper means 270.

In this example, the damper means 270 constitute in this example a suspension comprising one or more hydraulic dampers 262 connecting the first portion 281 to the second portion 283 of the carriage 271, these dampers being associated in parallel with springs 263.

It can be understood that during drilling the vibration generated by the cutter members 216 is transmitted along the bar 213 to the second portion 283 so as subsequently to be absorbed by the damper means 270, such that the vibration is not transmitted to the first portion 281 or to the boom 212. Without going beyond the ambit of the invention, the springs 263 could be arranged beside the dampers 262 without being axial thereabout.

The invention claimed is:

1. A drilling machine for making an excavation in ground in a drilling direction that is substantially vertical, said drilling machine comprising:

a support having a longitudinal direction;

a drilling module provided with cutter members, the drilling module being movable in translation relative to the support along the longitudinal direction of the support; and a movement device including at least one hydraulic jack arranged between the support and the drilling module in order to move the drilling module relative to the support along the longitudinal direction of the support;

wherein the movement device includes a damper assembly for damping the vibration generated by the drilling module while drilling, said damper assembly comprising a hydraulic damper device separate from the hydraulic jack and in fluid flow connection with the hydraulic jack of the movement device.

2. The drilling machine according to claim 1, wherein the hydraulic damper device comprises a spring accumulator which receives compressed hydraulic fluid from the hydraulic jack, damping a rise in pressure in the hydraulic fluid, thereby providing damping.

3. The drilling machine according to claim 1, wherein the drilling module has a bottom section carrying the cutter members, and a top section that passes longitudinally through said support, the top section being slidably mounted relative to said support and presenting a top end connected to the bottom end of a lift cable.

4. The drilling machine according to claim 3, wherein the support is a frame, the transverse dimensions of which, considered in a plane perpendicular to the longitudinal direction, are substantially equal to or less than the transverse dimensions of the drilling module, and wherein said frame includes an anchor device suitable for preventing the frame from moving relative to the walls of the excavation.

5. The drilling machine according to claim 1, wherein the damper assembly comprises a spring member arranged between the support and the drilling module.

6. The drilling machine according to claim 5, wherein the spring member comprises a coil spring.

7. The drilling machine according to claim 1, wherein the drilling module further comprises an anti-swinging device to prevent horizontal movement of the drilling module while drilling.

8. The drilling machine according to claim 7, wherein the anti-swinging device comprises deployable pads arranged on the lateral sides of the drilling module and arranged to co-operate with the walls of the excavation.

9. The drilling machine according to claim 1, further comprising a device for regulating the damping coefficient of the damper assembly.

10. The drilling machine according to claim 1, wherein the drilling machine is a milling machine having cutter members comprising two pairs of drums that are rotatable about axes of rotation that are parallel, distinct, and perpendicular to the longitudinal direction of the support.

11. A drilling machine for making an excavation in ground in a drilling direction that is substantially vertical, said drilling machine comprising:

a support having a longitudinal direction;

a drilling module provided with cutter members, the drilling module being movable in translation relative to the support along the longitudinal direction of the support; and a movement device including at least one hydraulic actuator arranged between the support and the drilling module in order to move the drilling module relative to the support along the longitudinal direction of the support;

wherein the movement device includes a damper assembly for damping the vibration generated by the drilling module while drilling, and wherein the damper assembly comprises a spring arranged between the support and the drilling module, said spring being mounted parallel and coaxial to the hydraulic actuator.

12. A drilling machine for making an excavation in ground in a drilling direction that is substantially vertical, said drilling machine comprising:

a support having a longitudinal direction and comprising a vertical boom;

a drilling module having a bar provided with cutter members situated at the bottom end of said bar, the drilling module being movable in translation relative to the support along the longitudinal direction; and a movement device comprising a carriage mounted on the vertical boom to be vertically slidable along the longitudinal direction, the carriage co-operating with said bar to move the drilling module in respect of the vertical boom along the longitudinal direction, wherein the carriage includes a damper assembly for damping the vibration generated by the drilling module while drilling, and wherein the carriage comprises a first portion slidably mounted on the vertical boom, a second portion co-operating with the bar, and wherein the damper assembly is arranged between the first and second portions of the carriage.

13. The drilling machine according to claim 12, wherein the damper assembly comprises a hydraulic actuator coupled to a hydraulic damper device.

* * * * *